US007303313B1

(12) United States Patent
Ma

(10) Patent No.: US 7,303,313 B1
(45) Date of Patent: Dec. 4, 2007

(54) CHRISTMAS DECORATION ASSEMBLY

(76) Inventor: Wen-Jui Ma, 7F, No.26, Alley 8, Lane 110, Chong-Hsin Road, Hsi-Chi City, Taipei Hsien (TW)

( * ) Notice: Subject to any disclaimer, the term of this patent is extended or adjusted under 35 U.S.C. 154(b) by 192 days.

(21) Appl. No.: 11/337,701

(22) Filed: Jan. 23, 2006

(51) Int. Cl.
*F21S 13/14* (2006.01)

(52) U.S. Cl. ..... 362/252; 362/249

(58) Field of Classification Search ..... 362/249, 362/252

See application file for complete search history.

(56) References Cited

U.S. PATENT DOCUMENTS 7,086,757 B2 * 8/2006 Wang ..... 362/249

* cited by examiner

*Primary Examiner*—Sandra O'Shea
*Assistant Examiner*—James W Cranson, Jr.

(57) ABSTRACT

A Christmas decoration assembly includes a plurality of parts overlapped to each other and each part is composed of rods. The parts have first connection devices on lower edges thereof and a second connection device on an upper edge thereof. The first and second connection devices connect the parts to each other. Each part includes rings connected thereto so as to position bulbs and a plurality of wires are wrapped to the parts and plastic beads or ribbons are attached to the wires.

6 Claims, 8 Drawing Sheets

CHRISTMAS DECORATION ASSEMBLY

BACKGROUND OF THE INVENTION

1. Field of the Invention

The present invention relates to a Christmas decoration assembly that can be quickly assembled by connection devices.

2. The Prior Arts

Most of the Christmas decoration assemblies are composed of different parts which are connected with each other by wires so that when assembling the Christmas decoration assemblies, the assemblers need some hand tools to tie the wires and the operation of the hand tools takes a lot of time especially when some assemblers cannot operate the hand tools properly. The parts are then connected with bulbs and/or ribbons. The bulbs usually are connected with an electric cable which needs to be well positioned on the parts of the Christmas decoration assembly and the Christmas decoration assemblies existed in the market do not provide proper positioning device to position the electric cables and/or bulbs. As shown in FIG. 8, the Christmas decoration assembly includes a hat part 10*a*, a head part 20*a* and a body part which is composed of an upper part 30*a* and a lower part 40*a*. These parts 10*a*, 20*a*, 30*a* and 40*a* are connected with each other by clamping devices. Each part has an electric cable 50*a* with bulbs and ribbons (not shown).

Nevertheless, the clamping devices are simply attached to the parts and no further positioning means are used to position the clamping devices so that the clamping devices easily drop from the parts by any unintentional impacts. Once the clamping devices fail to connect the parts, the electric cables might be tangled and pulled to more damage to the Christmas decoration assembly.

The present invention intends to provide a Christmas decoration assembly that can be quickly assembled by the connection devices and the bulbs are well positioned in each part of the Christmas decoration assembly.

SUMMARY OF THE INVENTION

A Christmas decoration assembly in accordance with the present invention includes a head part, an upper body part, a lower body part, and two arm parts connected to the upper body part so as to form a snowman decoration assembly. Each of the head part, the upper body part and the lower body part is composed of rods and overlapped with each other. The head part and the upper body part each have two first connection devices on a lower edge thereof and each first connection device includes an L-shaped plate and a notch is defined in the L-shaped plate. One of the notches of the head part and the upper body part is engage with a rod of the part that is being overlapped. The upper body part and the lower body part each have a second connection device on a top edge thereof and the second connection device includes a screw which is engaged with the other notch of the first connection devices on the head part and the upper body part.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
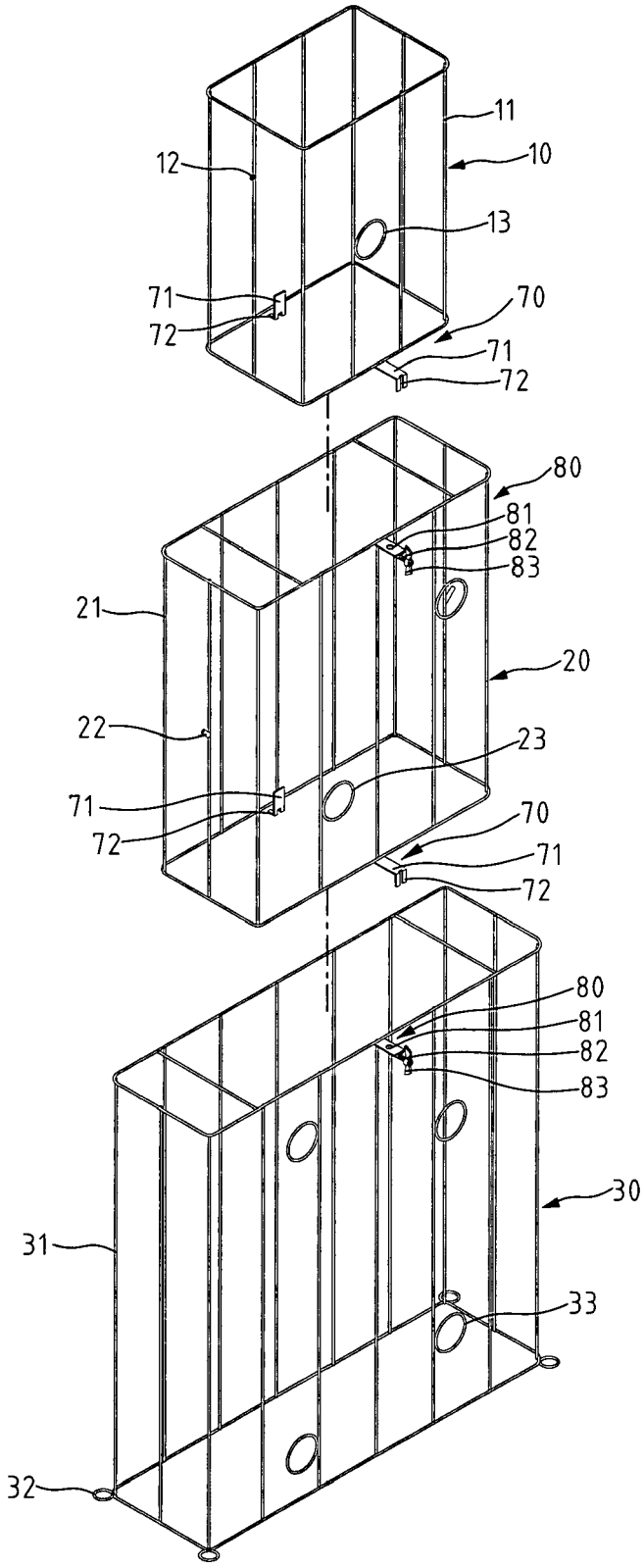
FIG. 1 is an exploded view showing a head part, an upper body part and a lower part in accordance with the present invention.
Figure 2:
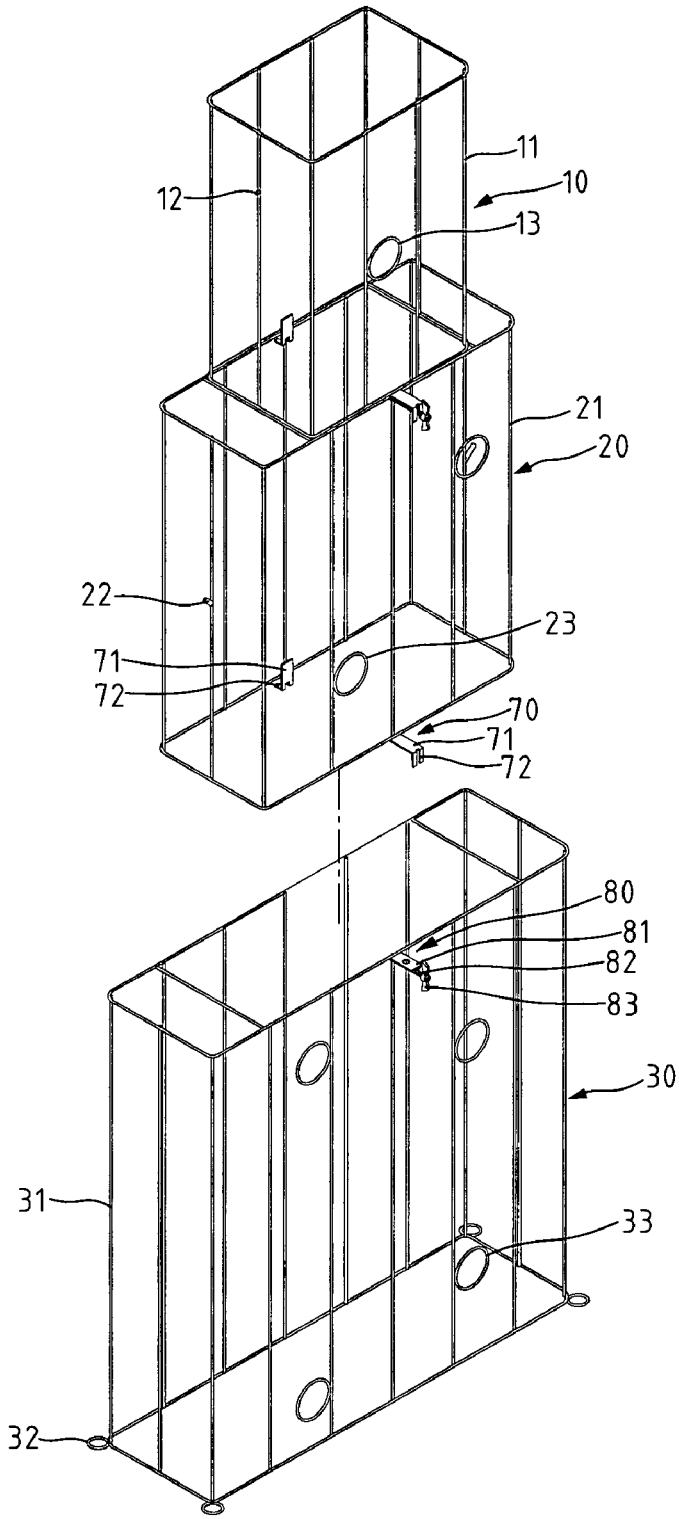
FIG. 2 shows that the head part is connected to the upper body part.
Figure 3:
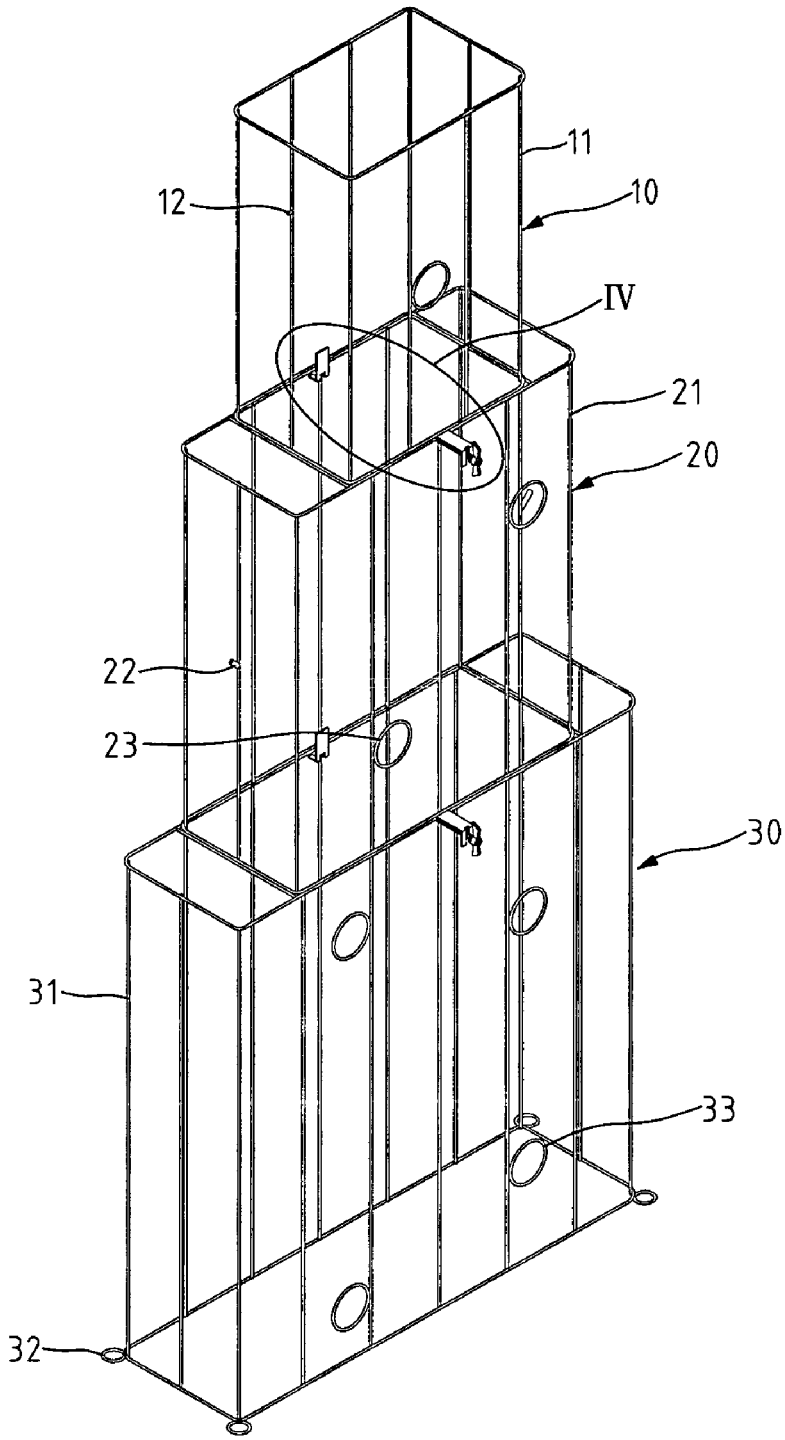
FIG. 3 shows the lower body part is connected to the upper body part.
Figure 4:
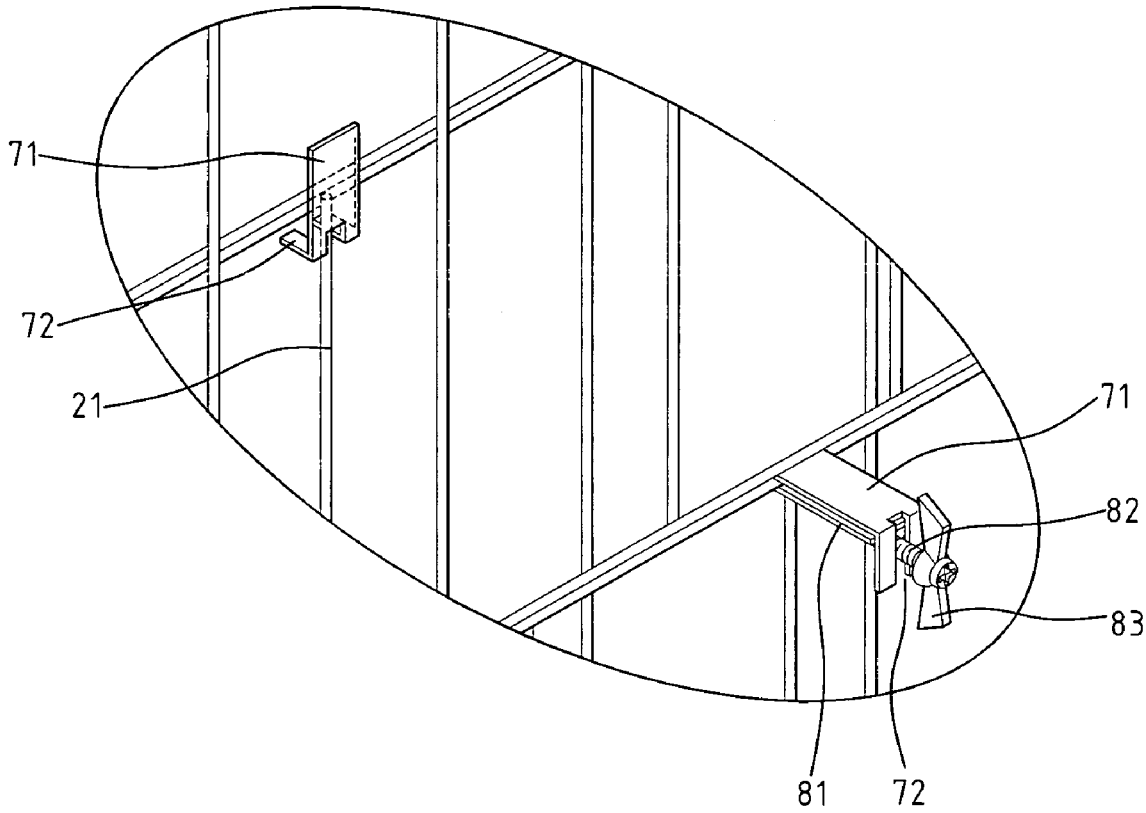
FIG. 4 is an enlarged view showing the designated portion IV in FIG. 3.
Figure 5:
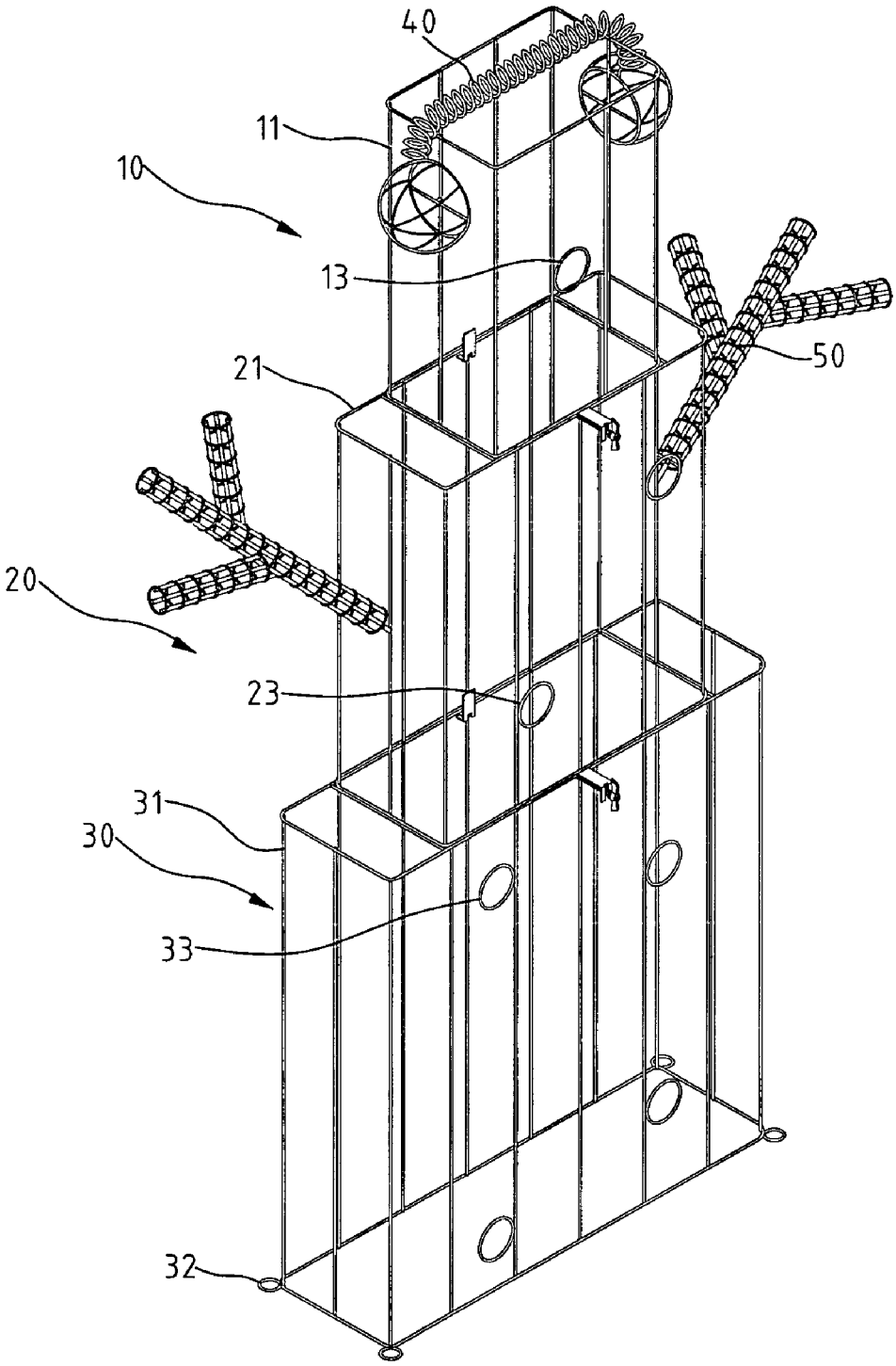
FIG. 5 shows that two arm parts and an ear-mask part are connected to the upper body part and the head part, respectively.
Figure 6:
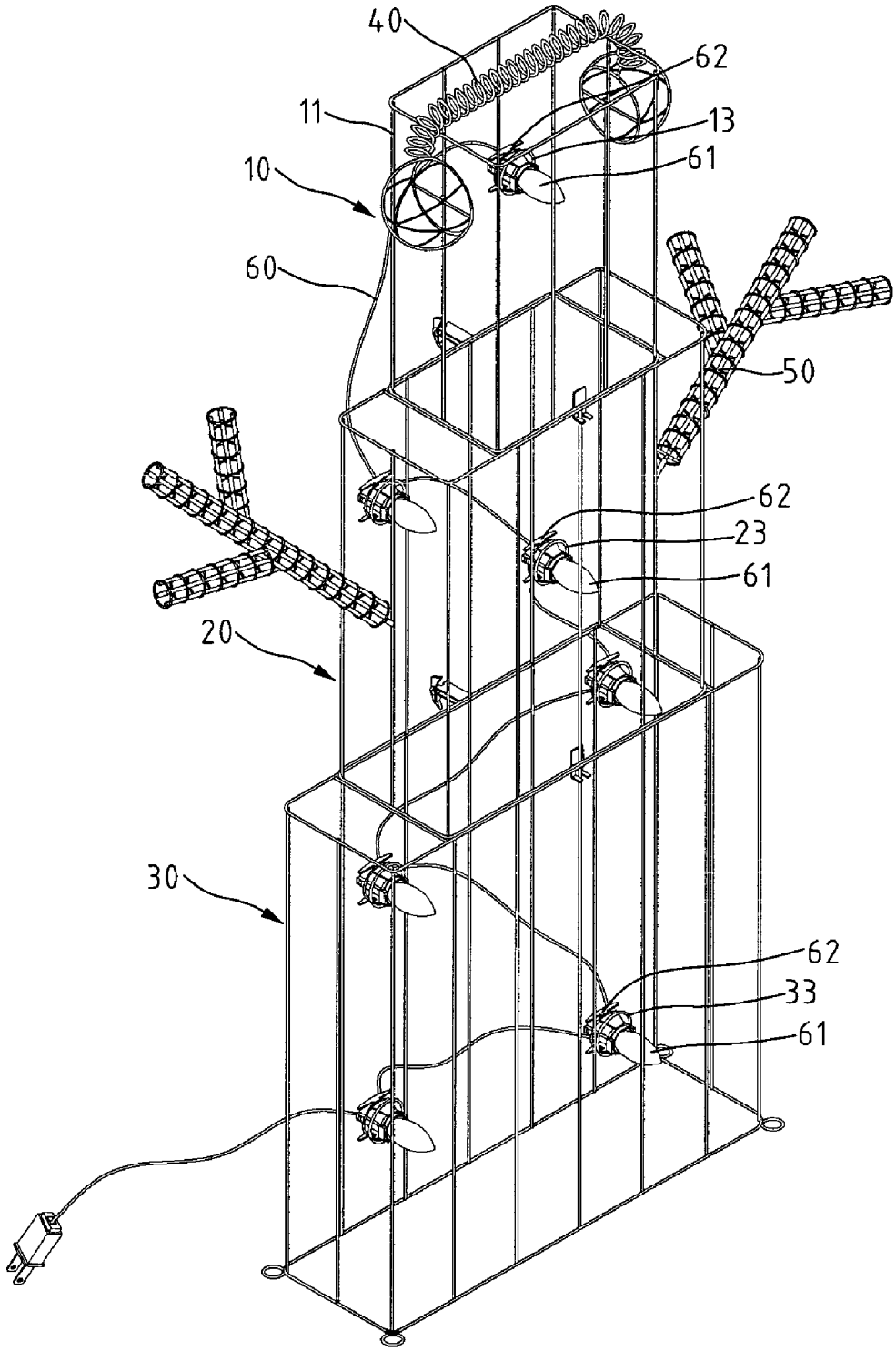
FIG. 6 shows that an electric cable with bulbs are connected to the Christmas decoration assembly wherein the bulbs are engaged with rings in the parts.

With reference to the drawings and in particular to FIGS. 1-6, a Christmas decoration assembly in accordance with the present invention comprises a head part 10, an upper body part 20, a lower body part 30, an ear-mask part 40 and two arm parts 50 connected to the upper body part 20 so as to form a snowman decoration assembly. Each of the head part 10, the upper body part 20 and the lower body part 30 is composed of rods 11, 21, 31 connected between two rectangular frames. Two first connection tubes 12 are connected to two rods 11 on two sides of the head part 10 and two second connection tubes 22 are connected to two rods 21 on two sides of the upper body part 20 such that the ear-mask part 40 are connected to the two first connection tubes 12 and the two arm parts 50 are connected to the two second connection tubes 22.

The head part 10 and the upper body part 20 each have two first connection devices 70 connected on a lower edge thereof and each first connection device 70 includes an L-shaped plate 71 and a notch 72 defined in the L-shaped plate 71. The L-shaped plates 71 of the two first connection devices 70 on the front side of the head part 10 and the upper body part 20 has the notch 72 defined in the upright portion thereof, and the L-shaped plates 71 of the two first connection devices 70 on the rear side of the head part 10 and the upper body part 20 has the notch 72 defined in the horizontal portion thereof. Therefore, when overlapping the head part 10 on the upper body part 20, and the upper body part 20 on the lower body part 30, the notches 72 in the horizontal portions of the L-shaped plates 71 are engaged with one of the rods 21 of the upper body part 20 and one of the rods 31 of the lower body part 30.

The upper body part 20 and the lower body part 30 each have a second connection device 80 connected to a top edge of the front side thereof and each second connection device 80 includes a plate 81 and a screw 82 extending from the plate 81. A nut 83 is connected to the screw 82. The screw 82 of the upper body part 20 is engaged with the notch 72 of the upright portion of the first connection device 70 on the front side of the head part 10 so that the head part 10 is connected to the upper body part 20 by securing the nut 83 on the screw 82 of the upper body part 20. The screw 82 of the lower body part 30 is engaged with the notch 72 of the upright portion of the first connection device 70 on the front side of the upper body part 20 so that the upper body part 20 is connected to the lower body part 30 by securing the nut 83 on the screw 82 of the lower body part 30.

Figure 7:
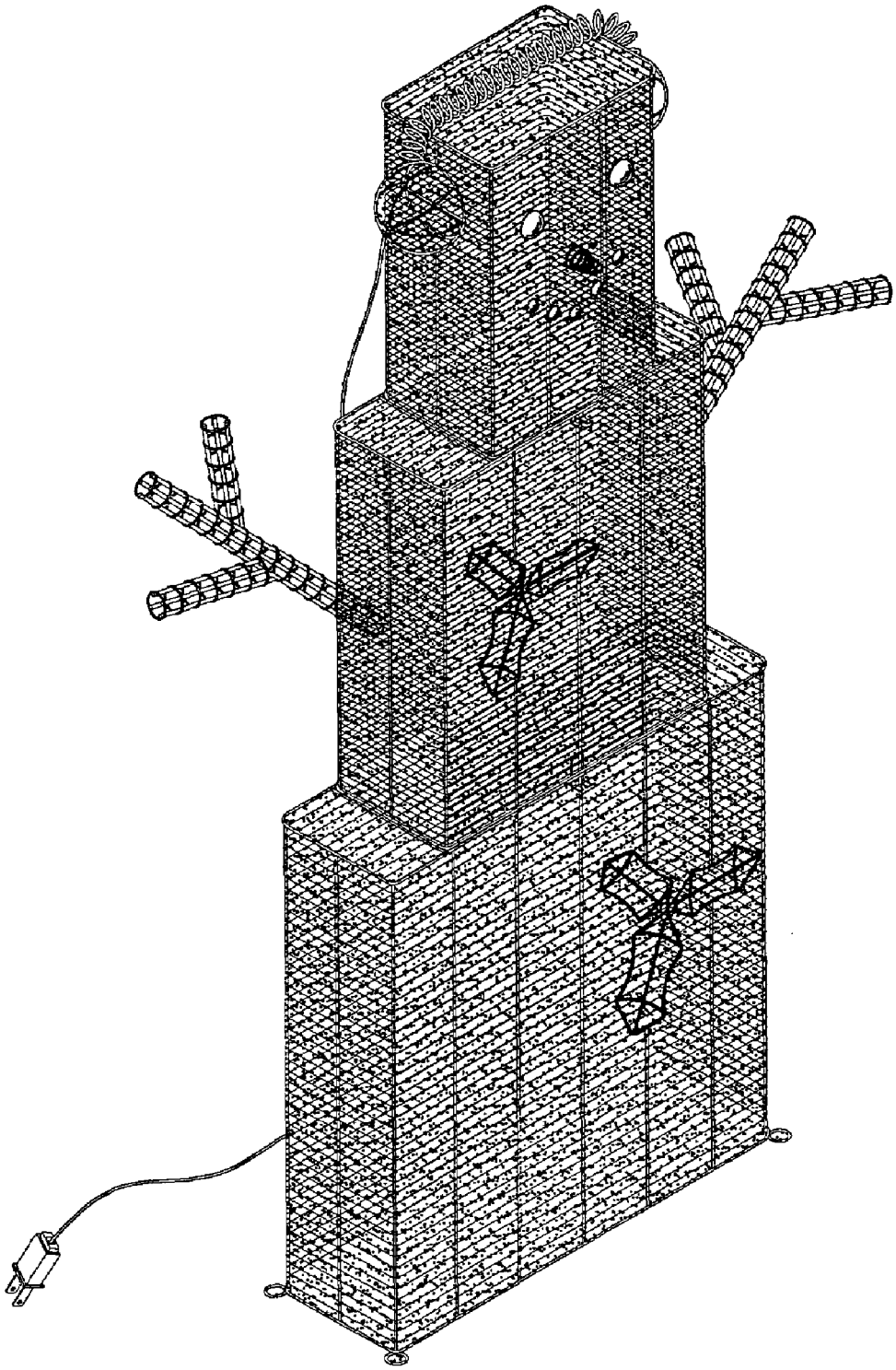
FIG. 7 shows the final status of the Christmas decoration assembly of the present invention.
Figure 8:
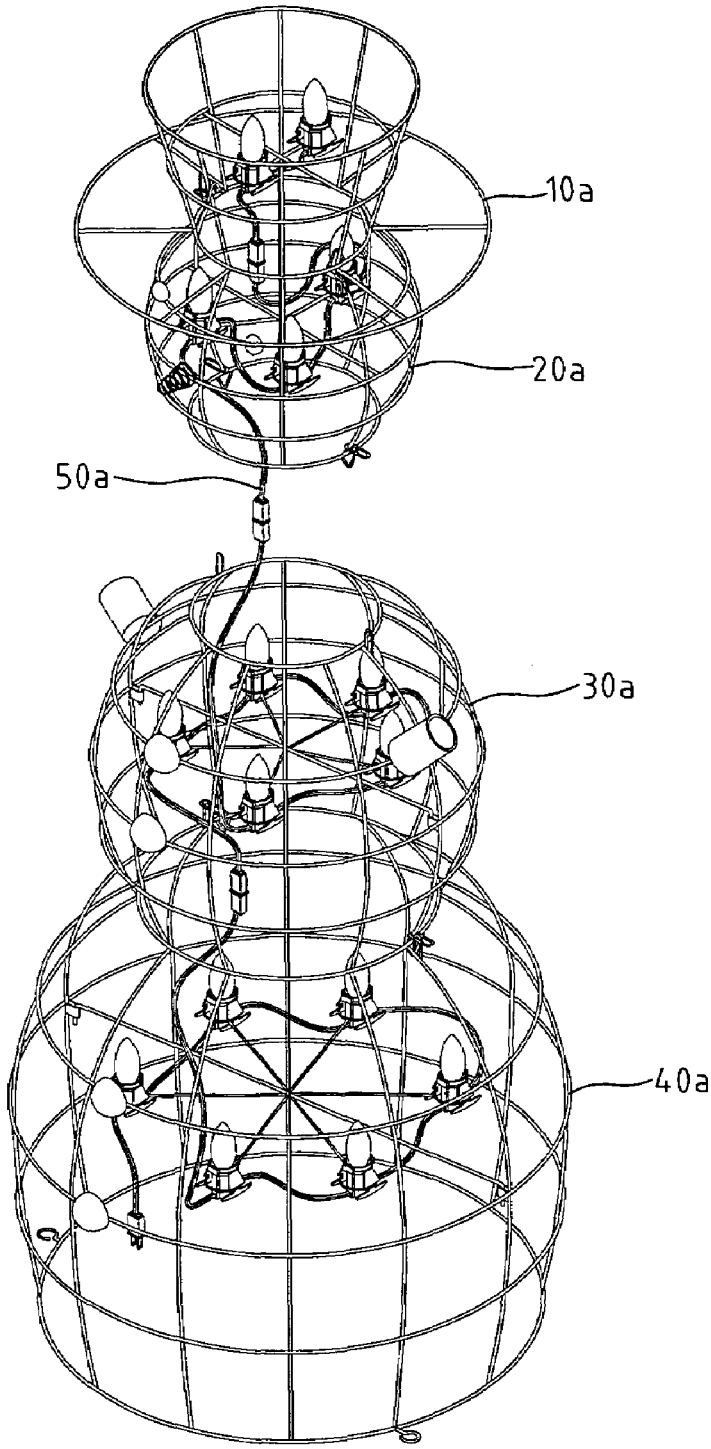
FIG. 8 (Prior Art)
FIG. 8 shows a conventional Christmas decoration assembly.

Each of the head part 10, the upper body part 20 and the lower body part 30 has a proper number of rings 13, 23, 33 connected to the rods 11, 21, 31 and at least one electric cable 60 is connected between the head part 10, the upper body part 20 and the lower body part 30. Bulbs 61 are connected to the electric cable 60 and secured to the rings 13, 23, 33 by clamping members 62. A plurality of wires are connected to the head part 10, the upper body part 20 and the lower body part 30, and plastic beads and ribbons are attached to the wires so as to form a final status of the Christmas decoration assembly as shown in FIG. 7.

The head part 10, the upper body part 20 and the lower body part 30 can be easily aligned and connected to each other by engaging the rods or screws with the notches of the first connection devices so that the assemblers can quickly assemble the decoration assembly. The nuts securely connect the head part 10 to the upper body part 20, and the upper body part 20 to the lower body part 30. The shapes of the decoration assembly of the present invention can be different, each part of which is easily set up by the connection devices.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A Christmas decoration assembly, comprising:

a main body including a first part and a second part, the first part overlapped on the second part, each of the first and second parts being composed of rods; and the first part having two first connection devices connected to a lower edge thereof and each first connection device including an L-shaped plate and a notch defined in the L-shaped plate, the second part having a second connection device on a top edge thereof and including a screw and a nut connected on the screw, one of the rods and the screw of the second connection device being engaged with the two respective notches of the two first connection devices, the nut securely connecting the first connection device to the second connection device.

2. The assembly as claimed in claim 1, wherein a plurality of wires are connected to the first and second parts and plastic beads are attached to the wires.

3. The assembly as claimed in claim 1, wherein each of the first and second parts has a plurality of rings connected thereto and bulbs are connected with an electric cable and engaged with the rings.

4. The assembly as claimed in claim 1, wherein the first part is a head part and the second part includes an upper body part and a lower body part, an ear-mask part is connected to the head part and two arm parts are connected on two sides of the upper body part.

5. The assembly as claimed in claim 1, wherein the L-shaped plate of each of the first connection devices has a horizontal portion in which the notch is defined.

6. The assembly as claimed in claim 1, wherein the second connection devices each have a plate and the screw horizontally extends from the plate.

* * * * *